United States Patent [19]

Lloyd et al.

[11] Patent Number: 5,063,015

[45] Date of Patent: Nov. 5, 1991

[54] METHOD FOR DEFLASHING ARTICLES

[75] Inventors: Daniel L. Lloyd, Mason; Eugene L. Cooke, Cincinnati, both of Ohio

[73] Assignee: Cold Jet, Inc., Loveland, Ohio

[21] Appl. No.: 559,491

[22] Filed: Jul. 24, 1990

Related U.S. Application Data

[63] Continuation of Ser. No. 322,368, Mar. 13, 1989, abandoned.

[51] Int. Cl.[5] ..... B26F 3/00; B29C 37/02

[52] U.S. Cl. ..... 264/161; 51/320; 83/914; 83/170; 264/232; 425/806

[58] Field of Search ..... 264/161, 232, 238, 28, 264/40.1; 83/53, 170, 914; 51/314, 317, 319, 418, 422, 436, 141, DIG. 51, 806; 225/1

[56] References Cited

U.S. PATENT DOCUMENTS

| | | | |
|---|---|---|---|
| 2,268,732 | 7/1942 | Hanrahan et al. | 297/2 |
| 2,380,653 | 7/1945 | Kopplin | 51/314 |
| 2,421,753 | 6/1947 | Joyce | 62/373 |
| 2,600,282 | 6/1952 | Strong | 51/164.1 |
| 2,699,405 | 1/1955 | Courts | 427/299 |
| 2,881,571 | 4/1959 | Granata | 51/164.1 |
| 2,996,846 | 8/1961 | Leliaert | 57/423 |
| 3,089,775 | 5/1963 | Lindall | 426/332 |
| 3,110,983 | 11/1963 | Moore | 51/422 |
| 3,137,101 | 6/1964 | Leliaert | 51/415 |
| 3,160,993 | 12/1964 | McCormick, Jr. | 51/416 |
| 3,324,605 | 6/1967 | Lester | 51/314 |
| 3,422,580 | 1/1969 | Balz | 51/314 |
| 3,485,074 | 12/1969 | Compton | 72/53 |
| 3,676,963 | 7/1972 | Rice et al. | 51/320 |
| 3,696,565 | 10/1972 | Claeys | 264/161 |
| 3,702,519 | 11/1972 | Rice et al. | 51/310 |
| 3,878,978 | 4/1975 | Martinek | 225/93.5 |
| 4,038,786 | 8/1977 | Fong | 51/320 |
| 4,355,488 | 8/1982 | Schmitz et al. | 51/319 |
| 4,389,820 | 6/1983 | Fong et al. | 51/410 |
| 4,617,064 | 10/1986 | Moore | 134/7 |
| 4,627,197 | 12/1986 | Klee et al. | 51/319 |
| 4,696,421 | 9/1987 | Dürr | 264/161 |
| 4,727,687 | 3/1988 | Moore | 51/410 |
| 4,744,181 | 5/1988 | Moore et al. | 51/436 |

FOREIGN PATENT DOCUMENTS

| | | | |
|---|---|---|---|
| 3543910 | 10/1986 | Fed. Rep. of Germany | 264/161 |

*Primary Examiner*—Jeffery Thurlow
*Assistant Examiner*—Mathieu Vargot
*Attorney, Agent, or Firm*—Frost & Jacobs

[57] ABSTRACT

The present invention includes a method for deflashing unwanted material from manufactured articles and more particularly a method for deflashing rigid reaction injection molded articles The method includes the steps of providing a continuous flow of frozen pellets, providing a workpiece having flashing, directing the flow of frozen pellets at the flashing and the workpiece, and impacting the flashing and the workpiece with the frozen pellets.

1 Claim, 1 Drawing Sheet

METHOD FOR DEFLASHING ARTICLES

This is a continuation of application Ser. No. 07/322,368, filed March 13, 1989, now abandoned.

TECHNICAL FIELD

The present invention relates generally to a method to deflash unwanted material from manufactured articles and is particularly directed to particle blast deflashing of a workpiece by using sublimable pellets. The invention will be specifically disclosed in connection with a reaction injection molded article which is fixtured in place and the flashing removed by directing a flow of sublimable pellets which is manipulated by a computer controlled robot.

BACKGROUND OF THE INVENTION

In recent years, industry has developed efficient methods for producing molded articles through reaction injection molding (RIM). Typically, plastic slugs are forced under extremely high pressures at very high speeds into molds in order to form the plastic into the shape of the desired article. High temperatures usually accompany such processes.

RIM articles may be created very quickly and are generally well suited for high volume production. The molded article can cure in the mold in as short a period of time as 90 seconds. Once the article is cured, the mold is opened or separated, the article removed, and the mold closed for the molding of the next piece. Thus, such a single cavity mold could produce as many as 40 pieces per hour. A multi cavity mold could produce proportionally more pieces per hour.

A major drawback with RIM articles is that excess unwanted material is molded adjacent the article. This is known as flashing and occurs at joints in the mold, at the split line between two halves, at the inlet for the material, or across open cavities formed in the article. There are numerous locations and causes of flashing. Flashing almost always forms around the entire perimeter of a molded article.

Deflashing is the process of removing the unwanted flashing from the article. This process is very labor intensive because of the length of time it takes and the inability to automate it. For rigid materials which, for the purposes of this patent, includes semi-rigid materials such as plastic, the flashing is typically cut by hand held knives.

The workpiece is usually fixtured in place and then a person uses a sharp knife, either manual or pneumatic, to cut away the flashing from the perimeter or edges of the workpiece. Once the flashing has been cut away, the process of deflashing is completed by smoothing the newly exposed edges with emery cloth or other slightly abrasive material.

The process of deflashing can take eight minutes or longer, depending upon the complexities of the workpiece. If the RIM process takes 90 seconds, the total time per piece is 9.5 minutes. To keep up with high volume capacity of a single cavity mold, six people would be required in this example. Thus, it is clear that a need exists to more efficiently deflash such workpieces.

Several methods have been tried without success. Automatically guided knives designed to trace the outline of the flashing based on computer control or tracing has not been successful. To practice this method, it is necessary to fix the workpiece precisely within a few thousandths of a theoretical position each time. Such fixing has not economically been achievable. Furthermore, the workpiece is subject to flexing and displacement when the cutting force of a knife is exerted against the material. Not only does this affect the accuracy of automated cutting (which is unacceptable), but it also limits the practical speed at which the flashing may be cut off.

Deflashing has also been attempted through abrasive particle blasting, such as sand blasting. This process has not met with success due to the damage caused to the exterior surface of the article. As would be expected, the surface finish of the manufactured article is very important while sand blasting can remove the flashing, it devastates the surface and is unacceptable.

There is a need for a process which can quickly deflash a workpiece without affecting the surface finish nor other physical characteristics of the workpiece.

SUMMARY OF THE INVENTION

Accordingly, it is a primary object of the present invention to provide a method of deflashing articles made of a rigid material by reaction injection molding which may be performed rapidly without degradation of the article itself.

It is another object of the present invention to provide a method of deflashing articles which may be accomplished through the use of programmable robots.

It is yet another object of the present invention to provide a method of deflashing which minimizes the amount of clean up required after completing the process.

Additional objects, advantages, and other novel features of the invention will be set forth in part in the description that follows, and in part will become apparent to those skilled in the art upon examination of the following, or may be learned with the practice of the invention. The objects and advantages of the invention may be realized and obtained by means of the instrumentalities and combinations particularly pointed out in the appended claims.

To achieve the forgoing and other objects, and in accordance with the purposes of the present invention herein, a method is provided for deflashing a rigid reaction injection molded article which may be accomplished rapidly. The method consists of providing a continuous flow of frozen pellets, providing a workpiece, and directing the flow of pellets at the flashing and the workpiece, and impacting both the workpiece and flashing with the pellets.

In accordance to a further aspect of the invention, the frozen pellets are made of a material which will sublimate into the gas phase under ambient conditions.

According to a further aspect of the present invention, the frozen pellets are composed of carbon dioxide.

In yet a further aspect of the present invention, the frozen pellets are cylindrical in shape.

According to a still further aspect of the present invention, the workpiece is formed by reaction injection molding.

In yet another aspect of the invention, the workpiece is made of plastic.

In still another aspect of the invention, robotic means are provided for directing the flow of frozen pellets; the robotic means are utilized to direct the flow of frozen pellets at the flashing and the workpiece; and the flashing and workpiece are impacted by the frozen pellets.

Still other objects of the present invention will become apparent to those skilled in this art from the following description wherein there is shown and described a preferred embodiment of this invention, simply by way of illustration, of one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Reference will now be made in detail to the present preferred embodiment of the invention, an example of which is aided by the accompanying drawings.

DETAILED DESCRIPTION OF THE PREFERRED EMBODIMENT

Figure 1:
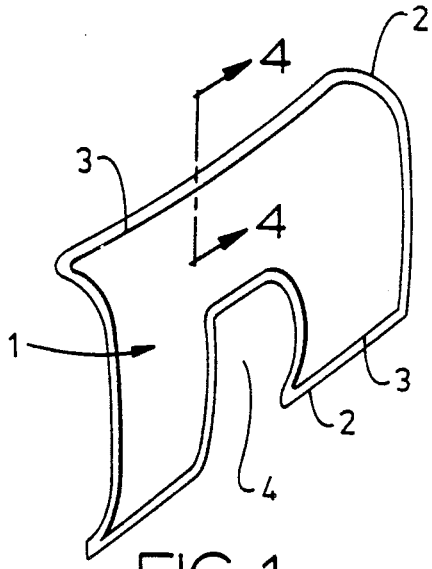
FIG. 1 is a perspective view of an automotive body panel having flashing.

Referring now to the drawings. FIG. 1 shows a plastic body panel 1, having a continuous stip of flashing 2 about the perimeter or edge 3 of the panel 1. A wheel well 4 is also shown as formed in panel 1. The panel was formed by reaction injection molding (RIM) which resulted in flashing 2 where the two mold halves separated (not shown).

Figure 4:
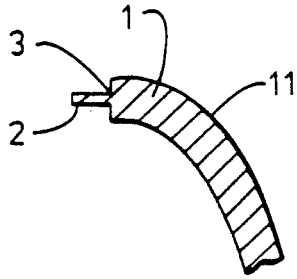
FIG. 4 is an enlarged cross sectional view taken along lines 4—4 of FIG. 1.
Figure 3:
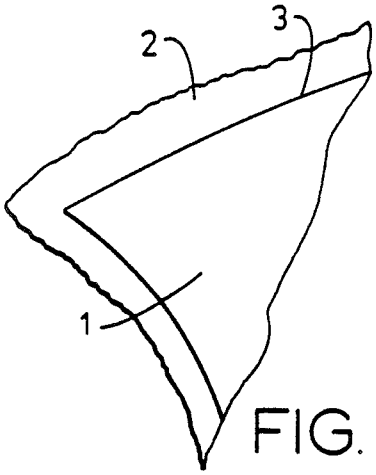
FIG. 3 is an enlarged fragmentary view of the corner of the body panel of FIG. 1.
Figure 5:
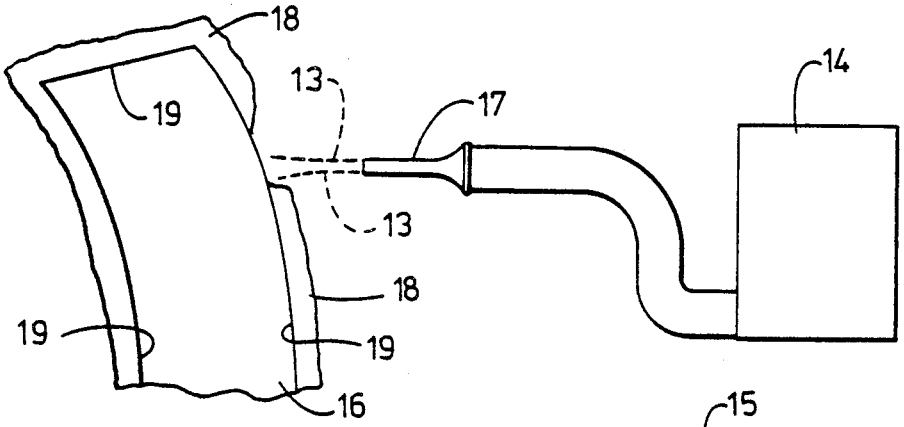
FIG. 5 is a schematical view of the process in operation.

An enlarged view of panel 1 is shown in FIG. 3, depicting the flashing 2. Flashing 2 may vary in thickness and length, depending on the material. FIG. 4 shows a cross section of the panel 1 and flashing 2, illustrating the general orientation, size, and shape of flashing 2.

Figure 2:
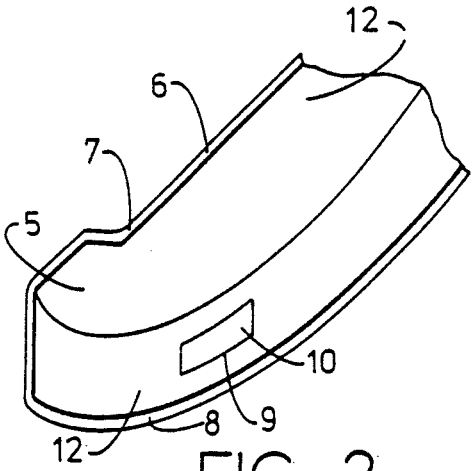
FIG. 2 is an automotive bumper having a flashed opening.

FIG. 2 shows an automotive bumper 5 with flashing 6 about the perimeter 7, as well as at the edges 8. An opening 9 is shown formed in the bumper 5, which has flashing 10 completely covering the opening 9.

Any of the flashing 2 or 9 may be removed without damage to the surface 11, 12 of the workpiece (panel 1 or bumper 5) by directing a continuous flow 13 from source 14 of frozen pellets 15. Such device is shown in U.S. Pat. No. 4,744,181 issued to Moore on May 17, 1988, which is incorporated by reference. Pellets 15 are directed towards the workpiece 16 through nozzle 17, and impact both the workpiece 16 and flashing 18. Workpiece 16 is fixed in place by any means well known in the art. Flexing of the workpiece 16, especially at the edges 19 where the flashing 18 is attached, will not hamper the deflashing operation.

Figure 6:
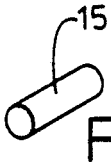
FIG. 6 is an enlarged view of a frozen pellet.

When the pellets 15 impact the workpiece 16 and flashing 18, the flashing 18 is broken off due to the impact of the pellets. The pellets 15 generally have a cylindrical shape as shown in FIG. 6. The pellets are a frozen material, such as carbon dioxide $CO_2$ is particularly well suited because it minimizes the clean up required due to its sublimation to the gas phase under ambient conditions.

The frozen $CO_2$ pellets 15 are abrasive enough to deflash the workpiece 16, but are not abrasive enough to degrade the surface finish of the workpiece 16. This results in part from the cylindrical shape of the pellets 15, described above. Other factors such as exit velocity and density of the pellets 15 also may affect the performance of the deflashing process.

While the process works on plastic articles, any rigid (including semi-rigid) material may be deflashed using this unique method.

The nozzle 17 may be directed by hand or mounted to a robot. As is well known, a robot can be adapted to direct the flow of frozen pellets at the flashing and workpiece.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

We claim:

1. A method for removing flashing from reaction injection molded articles, comprising the steps of:

(a) providing a workpiece which has been formed by reaction injection molding, said workpiece having a surface and having a flashing, said flashing being connected to said workpiece along an edge of said workpiece;

(b) providing a substantially continuous flow of carbon dioxide pellets while controlling the density of said carbon dioxide pellets so as to prevent degradation of said surface of said workpiece, said carbon dioxide pellets being generally cylindrical in shape, said carbon dioxide pellets being made of compressed carbon dioxide snow flakes which have been extruded through a die; and (c) directing said flow of carbon dioxide pellets at said workpiece along said edge so as to impact both said workpiece and said flashing and to cause said flashing to become disconnected from said workpiece at said edge.

* * * * *